US005488842A

United States Patent [19]

Nishioka et al.

[11] Patent Number: 5,488,842

[45] Date of Patent: Feb. 6, 1996

[54] METHOD FOR DEODORIZING AND REFRESHING FOR DRY CLEANING AND DRY CLEANING APPARATUS USING SUCH METHOD

[75] Inventors: Yukiko Nishioka, Kanagawa; Ichiro Kamiya, Tokyo; Ryoichi Shinjo; Yoshihiro Ishii, both of Kanagawa; Koichi Kosaka, Tokyo, all of Japan

[73] Assignee: Ebara Corporation, Tokyo, Japan

[21] Appl. No.: 293,338

[22] Filed: Aug. 24, 1994

[51] Int. Cl.[6] ..... D06F 43/08

[52] U.S. Cl. ..... 68/13 R; 68/18 R; 68/18 F; 68/209

[58] Field of Search ..... 68/13 R, 18 R, 68/18 F, 209; 210/167

[56] References Cited

U.S. PATENT DOCUMENTS

| | | | |
|---|---|---|---|
| 3,291,562 | 12/1966 | Anderson | 8/142 |
| 4,277,336 | 7/1981 | Henschel | 210/167 |

FOREIGN PATENT DOCUMENTS

| | | |
|---|---|---|
| 60074/73 | 3/1975 | Australia . |
| 0422603A1 | 4/1991 | European Pat. Off. . |
| 6-134479 | 5/1994 | Japan . |
| 6-154778 | 6/1994 | Japan . |
| 416523 | 1/1967 | Switzerland . |

OTHER PUBLICATIONS

Derwent Abstract: AN: 94–220628.

Patent Abstracts of Japan, vol. 16, No. 265 (C–0951), 1992.

*Primary Examiner*—Philip R. Coe

*Attorney, Agent, or Firm*—Armstrong, Westerman, Hattori, McLeland & Naughton

[57] ABSTRACT

The present invention provides a method for deodorizing and refreshing petroleum group solvent used in a dry cleaning apparatus, and a dry cleaning apparatus using such a method, which can maintain the circulating solvent in a fresh condition for a long time, eliminate a bad smell of the solvent, provide highly stable cleaning ability and good cleaning finish, and prevent ignition and explosion of the solvent to ensure safety. In the dry cleaning apparatus, the petroleum group solvent in a solvent storage tank 2 is pumped by a circulating pump 5, is supplied to a cleaning bath 8 through a filter 6 and carbon absorbent 7 and then is returned from the cleaning bath 8 to the solvent storage tank 2 through a button trap 3, and an ozone generating device 10 is provided for generating ozone gas and a diffuser 11 for pouring the ozone gas produced by the ozone generating device 10 Into the petroleum group solvent as fine bubbles are arranged to be contacted with a bottom surface of the solvent storage tank 2 or the button trap 3.

7 Claims, 5 Drawing Sheets

METHOD FOR DEODORIZING AND REFRESHING FOR DRY CLEANING AND DRY CLEANING APPARATUS USING SUCH METHOD

BACKGROUND OF THE INVENTION

1. Field of the Invention

The present invention relates to a method for deodorizing and refreshing solvent (i.e., removing odor from solvent) of the petroleum group used as cleaning liquid in a dry cleaning apparatus, and a dry cleaning apparatus using such a method.

2. Prior Arts

There are four kinds of solvents used in dry cleaning in the present time, i.e., petroleum group solvent, freon, trichloroethane and perchloroethylene. Nowadays, the petroleum group solvent is used the most while the use of freon and trichlorocthane is scheduled to be prohibited in the near future from the viewpoint of environmental pollution. Accordingly, the Increasing use of the dry cleaning apparatus using the petroleum group solvent is expected.

Problems to be Solved by the Invention

Since the emission regulation regarding the petroleum group solvent is not so strict in comparison to regulation governing the use of other solvents, the dry cleaning apparatus using the petroleum group solvent has less sealing ability than the dry cleaning apparatuses which use other solvents. Thus, the surroundings are contaminated by an offensive odor emitted from the volatilized petroleum group solvent and a bad smell emitted from accumulated polluted matter dissolved out of clothes or the like (i.e., laundry) which are being cleaned, and such offensive odors adhere to the cleaned clothes or the like.

In the dry cleaning apparatuses using the petroleum group solvent, since the solvent is stored in a solvent storage tank and is circulated to be re-used, the solvent is gradually polluted and worsened by the polluted matter dissolved out of the laundry as the cleaning is repeated. Normally, the dry cleaning apparatus using the petroleum group solvent has a filter for removing the polluted matters suspended in the solvent. However, such a filter cannot remove fine suspended matter and soluble dirt.

Further, filters incorporating absorbent such as active carbon therein have been proposed, and the filter has been used together with the absorbent. In such cases, the fine suspended matter and soluble dirt can be removed to some extent, but cannot be removed completely. Thus, the polluted components gradually accumulate in the solvent. Further, if the efficiency of the absorbent is worsened, the pollution of the solvent will be increased rapidly. The service life of the absorbent depends upon the degree of pollution in the laundry and/or cleaning conditions.

For example, in case of following cleaning method, the efficiency of absorbent is worsened in 3–7 days.

(1) Total cleaning laundry is about 700 kg a day.

(2) Combining batch cleaning for cleaning 20–25 kg each time, and filter circulation cleaning for overflowing the solvent and circulating the solvent through the filter.

(3) Cleaning time is about 8 minutes in each cycle.

Thus, it is difficult for the user to constantly maintain the solvent in a fresh condition, and such maintenance is very expensive. Further, even if the solvent is kept in fresh condition, the degree of recovery of cleaning ability of the solvent and washing ability is insufficient. In addition, if the dirty solvent is used without removing the polluted components, the laundry will be polluted by the solvent, thereby reducing the quality of the laundry.

Further, there is a method of purifying the solvent by utilizing distillation. In this case, however, the distillation has a limitation regarding the amount of the solvent to be purified. Accordingly, in the circulating solvent in a dry cleaning apparatus in which the dirt or pollution is constantly added or increased as the cleaning operation continues, it is very difficult to constantly maintain the solvent in the predetermined fresh condition. Further, notwithstanding the use of the Inflammable petroleum group solvent, since there is no positive measure to counter Ignition and explosion, accidental explosion or fires sometimes occur.

SUMMARY OF THE INVENTION

Problems to be solved by the Invention

The present invention aims to eliminate the above-mentioned conventional drawbacks, and an object of the present invention is to provide a method for deodorizing petroleum group solvent used in a dry cleaning apparatus to reuse the solvent, which can remove the bad smell of the petroleum group solvent and maintain the solvent in a fresh condition.

Another object of the present invention is to provide a dry cleaning apparatus which can maintain circulating solvent in a fresh condition for a long time, remove the bad smell of the solvent, provide stable cleaning ability and good cleaning finish by slightly improving a conventional dry cleaning apparatus using petroleum group solvent and which also can prevent ignition and explosion by monitoring temperature and conductivity of the solvent to maintain the environment surrounding the solvent in a lower-oxygen condition as much as possible, thereby ensuring safety.

Means for Solving the Problems

In order to solve the above problems, the present invention provides a method for deodorizing and refreshing solvent used in a dry cleaning apparatus having a cleaning bath, a solvent storage tank and a circulating pump which are interconnected to each other through a solvent circulating path so that the petroleum group solvent is pumped from the solvent storage tank by the circulating pump to be supplied to the cleaning bath through the solvent circulating path and then the solvent is returned from the cleaning bath to the solvent storage tank, which method comprises the steps of applying ozone gas as fine bubbles into the petroleum group solvent including polluted matter dissolved out Of the laundry by the cleaning to oxidize, decompose and aggregate odor components of the solvent itself, bad smell components of the polluted matter and the polluted matter itself, and then the solvent is passed through a filter and/or absorbent to remove the polluted matter, thereby the solvent is deodorized and purified.

Further, the dry cleaning apparatus is provided with a filter for removing the polluted matter included in the solvent disposed within the solvent circulating path, and the ozone gas is applied into the solvent after the solvent has passed through the cleaning bath and before the solvent passes through the filter.

Furthermore, the application of the ozone gas is effected in synchronization with the operation of the dry cleaning apparatus so that the ozone gas is applied only when the dry cleaning apparatus is operated.

Further, at least one of active carbon, active alumina and active clay is used as the absorbent so that the residual ozone remaining in the solvent can be decomposed.

In addition, the filter and the absorbent are arranged in such a manner that the solvent passes through the absorbent after it passed through the filter, and the ozone gas is applied into the solvent before the solvent passes through the filter so that the bad smell of the polluted matter which adheres to the filter is decomposed by ozone and then the residual ozone remaining in the solvent is decomposed by the absorbent.

Further, the dry cleaning apparatus according to the present invention is provided with an absorption means for absorbing the polluted matters and the like included in the solvent disposed within the solvent circulating path, which absorption means includes at least one of active carbon, active alumina and active clay. The absorption means includes at least one of active carbon, active alumina and active clay, and at least one of zeolite, silica gel and ion-exchange resin. Ozone gas generated by electrical discharge in a gas in which oxygen density is 70 vol % or more is used as the ozone gas to be applied into the solvent.

The dry cleaning apparatus according to the present invention further comprises a button trap disposed between the cleaning bath and the solvent storage tank so that the solvent from the cleaning bath is sent to the solvent storage tank through the button trap for circulation, and a diffuser for applying the ozone gas into the petroleum group solvent as fine bubbles is arranged so that the a portion of the diffuser is contacted with a bottom surface of the button trap.

Preferably, the dry cleaning apparatus includes a case which is made of net-like material or porous material. A portion of the diffuser is contacted with a bottom surface of the case, and the case is arranged so that it is contacted with a bottom of the solvent storage tank or the button trap.

Alternatively, the case may have no bottom surface. In this case, a lower end of the case is contacted with the bottom of the solvent storage tank or the button trap, and a portion of the diffuser is contacted with a portion of the bottom of the solvent storage tank or the button trap encircled by the lower end of the case.

Preferably, an upper end of the case made of net-like material or porous material is closed by net-like material or porous material, or by a lid made of net-like material or porous material, and the lid is covered by a cloth or fibrous material.

Preferably, a temperature sensor for detecting a temperature of the solvent is arranged in the solvent circulating path at a predetermined position. If the temperature of the solvent is risen above a predetermined value lower than an ignition point of the solvent, an alarm is emitted and/or an ozone generating means is stopped.

Preferably, a conductivity sensor for detecting conductivity of the solvent is arranged in the solvent circulating path at a predetermined position. If the conductivity of the solvent is lowered under a predetermined value higher than 0.0001 μs/cm, the alarm is emitted and/or the ozone generating means is stopped.

Further, nonflammable gas may be introduced into a gaseous space within the solvent storage tank.

Function

As mentioned above, according to the method of the present invention, a contact area between the ozone gas formed as the fine bubbles and the solvent is increased by applying the ozone gas into the petroleum group solvent including the polluted matter dissolved out of the laundry, with the result that the ozone is dissolved into the solvent effectively and well reacts on the bad smell components of the solvent and on the polluted matter generating the bad odor, thereby removing the bad smell or odor effectively. Further, since the residual ozone remaining in the solvent is decomposed by the absorbent comprised of at least one of the active carbon, active alumina and active clay, there is no need to provide any device for decomposing the residual ozone. Furthermore, since the polluted matter in the solvent is oxidized, decomposed and aggregated under the action of the ozone, the polluted matter can easily be removed by the filter and/or the absorbent, and the petroleum group solvent can be maintained in the fresh condition.

Further, since the ozone gas is applied into the petroleum group solvent through the fine pores on the diffuser, the contact area between the ozone gas and the solvent is increased, with the result that the reaction between the ozone and the polluted matter is enhanced, thereby the polluted matter can be oxidized, decomposed and aggregated effectively.

Since the ozone gas is applied in the solvent circulating path at a downstream of the cleaning bath and at an upstream of the filter, the ozone acts on the solvent including polluted matters, and, since the polluted matter which are oxidized, decomposed and aggregated under the action of the ozone, are promptly removed by the filter and/or the absorbent, the solvent can be purified effectively.

Further, in the case where the active carbon is used as the absorbent for absorbing and removing the polluted matter oxidized, decomposed and aggregated under the action of the ozone, if ozonized air obtained from electrical discharge in air is used as the ozone gas to be applied into the solvent, there is a danger of explosion because of reaction between the active carbon and NOx in the ozonized air. However, in the present invention, since the ozone gas generated by electrical discharge in a gas in which oxygen density is 70 vol % or more is used as the ozone gas to be applied into the solvent, the amount of NOx in the ozone gas is very little, thereby such explosion is prevented.

Further, in the dry cleaning apparatus according to the present invention, since the diffuser is arranged so that the side surface of the diffuser is contacted with the bottom of the solvent storage tank or the button trap disposed at the downstream of the cleaning bath and the ozone gas is applied from the ozone generating means into the petroleum group solvent including the polluted matter, the polluted matter in the solvent is oxidized, decomposed and aggregated under the action of the ozone gas and is removed by the filter and/or the absorbent, thereby it is possible to maintain the petroleum group solvent in the fresh condition and provide stable cleaning ability and good cleaning finish can be maintained for a long time. Further, by applying the ozone gas into the solvent, since the bad smell of the petroleum group solvent can be removed due to the deodorizing action of ozone, the cleaning environment can be maintained in a good condition.

Further, since the temperature sensor for detecting the temperature of the solvent and the conductivity sensor for detecting the conductivity of the solvent are arranged in the solvent circulating path at the predetermined positions so that, if the temperature of the solvent is risen above the predetermined value lower than the ignition point of the solvent and if the conductivity of the solvent is lowered below the predetermined value higher than 0.0001 μs/cm, the alarm is emitted and/or the ozone generating means is stopped, ignition or explosion can be prevented.

Further, since the nonflammable gas is introduced into the gaseous space within the solvent storage tank, the danger of ignition can be further reduced.

Further, in the case where the diffuser is arranged within the case made of net-like material or porous material and the case is arranged on the bottom of the button trap or the solvent storage tank, if a liquid level in the button trap is low or if it is difficult to install the diffuser in the button trap, by spraying or dispersing the ozone gas within the case, foam generated from soap agent (surface-active agent) and foaming agent added to the solvent swells to form a foam lid on the case.

Due to the presence of such foam, since the chance of contact between the solvent and low density ozone gas which was not melted into the solvent and which comes out together with oxygen is increased and a contact area between the solvent and the low density ozone gas is also increased, the ozone can be consumed efficiently, and, even if the liquid level is low, the ozone gas can be prevented from escaping into the atmosphere. Further, when the case is installed in the solvent storage tank, the diffuser can be fixed, by the case, at a predetermined position (for example, an opening position near a pumping inlet of the circulating pump) in the wide solvent storage tank so that the diffuser can be prevented from shifting within the solvent storage tank.

Further, when the lid made of net-like material or porous material is attached to the case made of net-like material or porous material and the cloth or fibrous material is secured onto the lid, and the cloth or fibrous material is always maintained in a wetted condition by the polluted solvent from the cleaning bath or replenished solvent, even if a small amount of ozone gas which was not consumed is generated, since such ozone gas is contacted with the cloth or fibrous material wetted by the polluted solvent thereby to decompose the ozone gas, it is possible to prevent the ozone gas from escaping into the atmosphere.

DETAILED DESCRIPTION OF THE PREFERRED EMBODIMENTS

The present invention will now be explained in connection with embodiments thereof with reference to the accompanying drawings.

Figure 1:
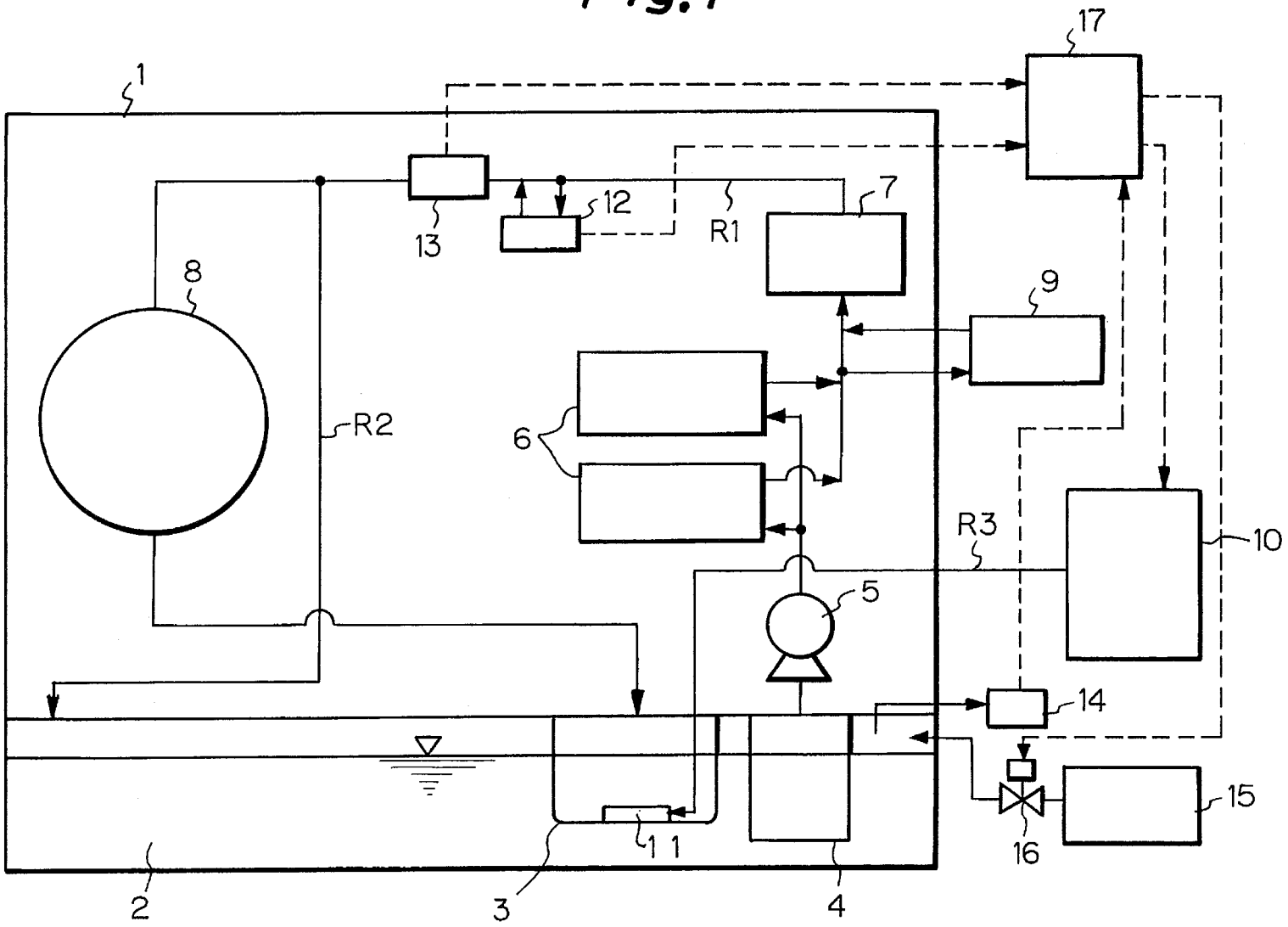
FIG. 1 is a block diagram showing a dry cleaning apparatus using petroleum group solvent to which a solvent reproducing method according to the present invention is applied.

FIG. 1 is a block diagram showing a dry cleaning apparatus using petroleum group solvent to which a solvent refreshing method according to the present invention is applied. The dry cleaning apparatus comprises a dry cleaning machine 1, a heat exchanger 9 and an ozone generating device 10. The dry cleaning machine 1 comprises a solvent storage tank 2, a button trap 3, a pre-filter 4, a circulating pump 5, cartridge filter tanks 6, a carbon tank 7 and a cleaning bath 8.

The button trap 3 serves to remove large foreign matter such as a button included in solvent. A diffuser 11 is arranged to be contacted with a bottom surface of the button trap 3. Ozone gas from the ozone generating device 10 is introduced into the diffuser 11 through a conduit R3 and the ozone gas is applied into the solvent (petroleum group solvent) as fine bubbles through porous material of which the diffuser is made. The solvent contacted with the ozone gas is sent from the button trap 3 to the solvent storage tank 2 while effecting reaction between ozone and polluted matter (dissolved out of the laundry) mixed with and dissolved into the solvent. Incidentally, the reason why the diffuser is arranged on the bottom of the button trap 3 is to prolong the time of contact between the finely bubbled ozone gas and the solvent. To this end, a liquid level of the solvent above the diffuser 11 in the button trap 3 should be maintained to 10 cm or more. Further, the reason why the diffuser 11 is contacted with the bottom surface of the button trap 3 is to prevent electrical charging.

The solvent is pumped from the solvent storage tank 2 by the circulating pump 5 through the pre-filter 4; meanwhile, relatively large floating matter included in the solvent is removed by the pre-filter 4. Then, the solvent flows through a solvent circulating path R1. The solvent passes through the cartridge filter tanks 6 and the carbon tank 7 disposed in the solvent circulating path R1 to flow into the cleaning bath 8. The laundry is washed in the cleaning bath 8 using the solvent which in turn flows out through an outlet opening of the cleaning bath. Then, the solvent is returned to the solvent storage tank 2 through the button trap 3.

A paper filter of cartridge type is contained in each of the cartridge filter tanks 6, and active carbon or active clay or active alumina is contained in the carbon tank 7. The polluted matter oxidized, decomposed and aggregated under the action of ozone is caught and absorbed by the paper filters in the cartridge filter tanks 6 and the active carbon or the like in the carbon tank 7, thereby the polluted matter is removed. The cleaned solvent from which the polluted matter was removed is supplied to the cleaning bath 8 through the solvent circulating path R1. Further, when the cleaning bath 8 is stopped or when the batch cleaning is being effected by using the solvent contained in the cleaning bath 8, the cleaned solvent flows into a circulating path R2 branched from the solvent circulating path R1 at a downstream of the carbon tank 7 and then is returned to the solvent storage tank 2 directly without passing through the cleaning bath 8. Incidentally, the heat exchanger 9 serves to lower a temperature of the solvent (under an ignition point or firing point of the solvent).

In the dry cleaning apparatus having the arrangement as mentioned above, for example, a circulating quantity of the petroleum group solvent is 300 l/min. And, when it is assumed that an amount of solvent stored in the solvent storage tank 2 is 700–750 liters, the solvent is contacted with new ozone gas every about 2.5 minutes, and the polluted matters included in the solvent are oxidized, decomposed and aggregated under the action of the ozone, and are removed by the filters and absorbent. Accordingly, even when the ozone gas is applied into the solvent only during the operation of the dry cleaning apparatus, the solvent can be cleaned and refreshed.

Since the ozone gas is applied as the fine bubbles from the diffuser 11 disposed in the button trap 3 which is one of opening portions (through which a bad smell leaks) of the solvent circulating path of the dry cleaning apparatus having the above-mentioned arrangement, the ozone gas acts on the smell components in the solvent (smell components of the solvent itself and smell components of the polluted matter dissolved Into the solvent) effectively to decompose the smell components and to prevent the bad smell from escaping into the atmosphere. Further, since the solvent including the polluted matter discharged from the cleaning bath 8 always passes through the button trap 3 before the solvent flows into the solvent storage tank 2, the ozone reacts against the solvent before the polluted matter is dispersed, thereby prevented the smell components of the polluted matter from entering into the solvent circulating path R1 disposed at the downstream side of the button trap 3.

The solvent into which the ozone is dissolved in the button trap 3 reaches the cartridge filter tanks 6 through the solvent circulating path R1. In the cartridge filter tanks 6, the ozone dissolved into the solvent acts on the polluted matter caught by the paper filters in the tanks, thereby decomposing the smell components to deodorize the solvent. Due to the above-mentioned deodorizing action, the inherent odor of the solvent itself and the bad smell of the polluted matter are removed, and, thus, the solvent having substantially no smell can be supplied to the cleaning bath 8, thereby preventing the odor or smell from transferring onto the laundry.

As mentioned above, in the dry cleaning apparatus having the arrangement as mentioned above, the circulating amount of the solvent is 300 l/min. And, when the amount of solvent stored in the solvent storage tank 2 is 700–750 liters, the solvent is contacted with new ozone gas every about 2.5 minutes to be deodorized. It was found that, when the ozone gas having ozone density of 80 mg/l is applied at a flow rate of 1 Nl/min, the bad odor of the solvent disappears when 1 minute has elapsed after the application of the ozone gas starts, and the deodorized condition is maintained. Further, it was found that, even when the ozone density is charged within a range of 10–100 mg/l, the deodorizing ability is not changed substantially, and the deodorized condition is always maintained even when the ozone gas is applied only during the operation of the dry cleaning apparatus.

Since the ozone is usually harmful when ozone gas is used, any apparatus with which the ozone gas is used must be constructed to prevent the ozone gas from leaking from the apparatus, and an ozone decomposing process bath should be arranged at the outlet opening of the apparatus. However, in the present invention, since the petroleum group solvent has ozone melting or dissolving ability greater than water by about ten times and the ozone dissolving and reacting ability is enhanced by using the diffuser 11, it is considered that all ozone is consumed by the dissolution and reaction. Accordingly, in the illustrated embodiment, an ozone decomposing process is not required.

Since the ozone dissolved into the solvent reacts against the polluted matter promptly, it is considered that no ozone is dissolved into the solvent until the solvent flowing in the solvent circulating path R1 reaches the active carbon or active clay in the carbon tank 7 through the paper filters in the cartridge filter tanks 6. Even if a small amount of ozone remains in the solvent, the residual ozone is decomposed by the active carbon or active clay or active alumina in the carbon tank 7, with the result that the ozone does not effect a bad influence upon the laundry in the cleaning bath 8. In order to ascertain the leakage of ozone in the illustrated embodiment, an amount of ozone was measured in the proximity of a surface of the solvent into which the ozone is applied as the fine bubbles in the button trap 3 from which the ozone is most likely to leak. In this case, the ozone could not be detected. Further, although an amount of ozone was measured within the dry cleaning machine 1 including the petroleum group solvent and at many points around the dry cleaning machine, no ozone could be detected. In this way, it was found that the ozone can be prevented from leaking outside.

As shown in FIG. 1, by arranging the diffuser 11 from which the ozone gas is applied into the solvent on the bottom of the button trap 3 to which the solvent circulating path is opened, the ozone can be advantageously applied into the solvent without Improving the conventional dry cleaning machine and adding special device to the conventional dry cleaning machine. Further, since the button trap 3 is a mostly smudged portion in the solvent circulating path, by installing the diffuser 11 in the button trap 3 and by pouring the ozone gas (03) from pores formed in the side wall of the diffuser into the solvent, the ozone gas reacts against the dirt and bad smell components in the solvent effectively, thereby they can be oxidized, decomposed and aggregated.

Further, since the dirt and bad smell components oxidized, decomposed and aggregated under the action of the ozone gas are promptly pumped together with the solvent by the circulating pump and then are caught by the paper filters in the cartridge filter tanks 6 and absorbed to the active carbon or the like in the carbon tank 7, the dirt and bad smell components can be removed efficiently, thereby the cleaned and deodorized solvent can always be supplied to the cleaning bath 8. Thus, since the laundry is always washed by the cleaned and deodorized solvent in the cleaning bath 8, the highly stable cleaning can be achieved and the dirt removing rate (cleaning rate) can be enhanced.

Figure 2:
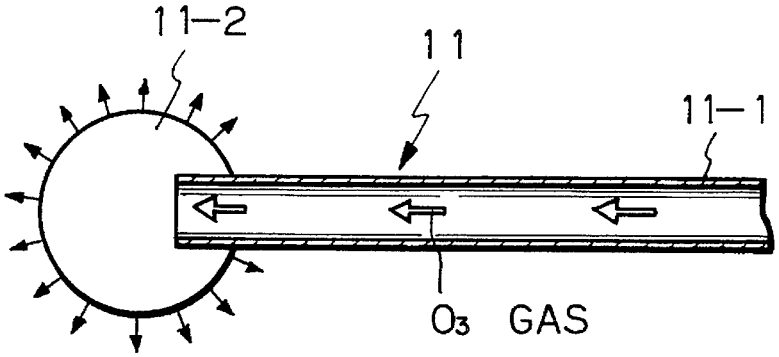
FIGS. 2 and 3 are sectional views showing a portion of a diffuser for applying ozone gas into the solvent.

FIG. 2 shows an example of the construction of the diffuser 11. The diffuser 11 comprises a tube portion 11-1 made of Teflon, and a ball 11-2 made of Teflon and attached to a tip end of the tube portion 11-1. A number of pores each having a diameter of 10–100 μm are formed in the ball 11-2. The ball 11-2 made of Teflon is arranged in such a manner that It is contacted with the bottom surface of the button trap. The ozone gas ($O_3$) from the ozone generating device 10 Is sent into the ball 11-2 through the tube portion 11-1 made of Teflon. Then, the ozone gas is sprayed and applied into the solvent through the number of fine pores of the ball 11-2 as fine bubbles.

Figure 3:
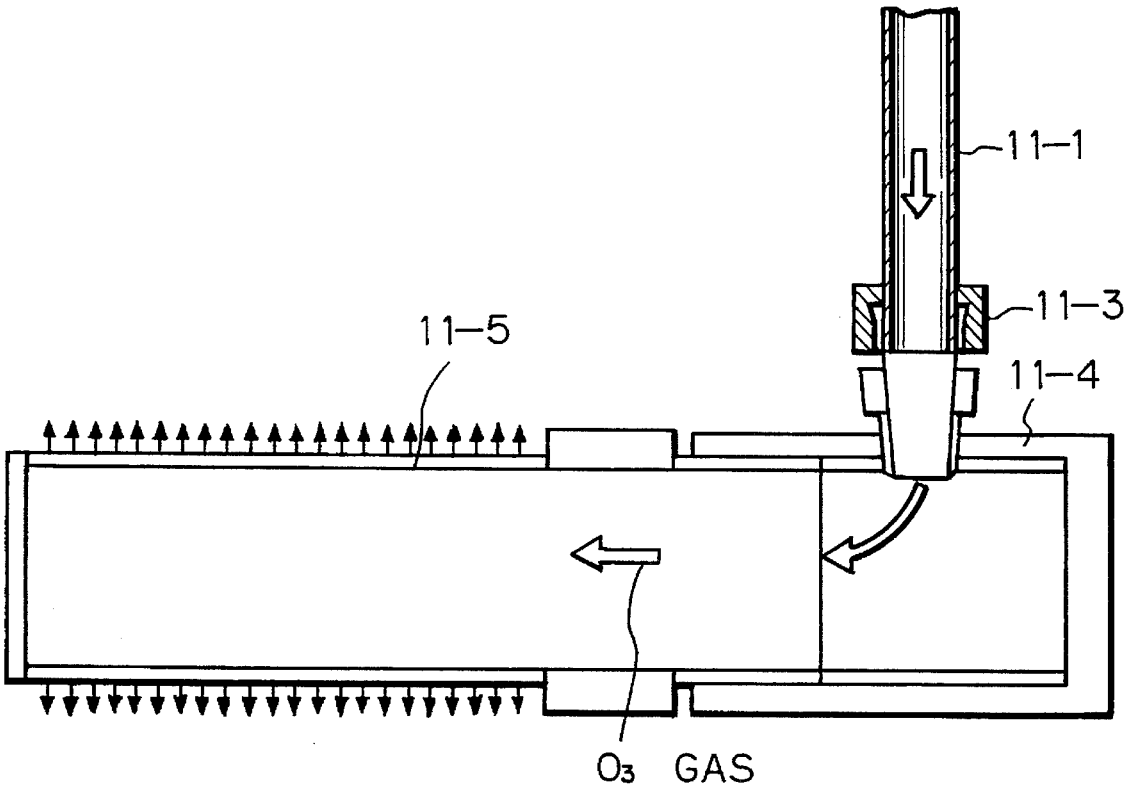

Incidentally, although the diameter of each of the fine pores which are formed in the diffuser 11 and from which the ozone gas is sprayed is not limited to a certain value, in order to increase the contact area between the ozone gas and the solvent and to react the ozone against the polluted matter efficiently, the diameter of each fine pore may be minimized so long as pressure loss is not so high. Further, the material of the diffuser portion for spraying the ozone gas Is not limited to Teflon, but may be stainless steel (SUS), and, for example, as shown in FIG. 3, the diffuser may be constituted by a tube 11-1 made of Teflon connected to a pipe 11-4 made of stainless steel (SUS) via a joint, and a mesh pipe 11-5 having a number of fine pores formed in a peripheral surface thereof and connected to an end of the pipe 11-4.

Further, the position of the diffuser 11 of the dry cleaning apparatus is not limited to the interior of the button trap 3 as shown in FIG. 1, but the diffuser 11 may be arranged in the solvent circulating path at a downstream of the cleaning bath 8 and an upstream of the cartridge filter tanks 6 and the carbon tank 7. Thus, the diffuser may be installed in any position where the diffuser can easily be inserted into the solvent circulating path. Further, on installing the diffuser 11, in order to prevent the charging as mentioned above, the peripheral surface of the diffuser should be contacted with a wall in the position where the diffuser is installed.

In the illustrated embodiment, it was found that, when the ozone gas is applied into the solvent from the above-mentioned diffuser 11 in the above-mentioned manner for 8–10 hours a day at a maximum ozone amount of 9 g/h for two months, it is possible to maintain the transmission factor of light having a wavelength of 500 nm in a value more than 90% and to provide a high transparent clean solvent which does not include any floating component. Further, according to a re-pollution test appropriately performed by using cloth webs for checking a polluted condition, it was found that the polluted condition is not ascertained, and, thus, the solvent has been maintained in a fresh condition. In addition, according to a test for checking cleaning ability, it was found that a highly stable cleaning rate can always be obtained, and, thus, the solvent is maintained in a good condition.

Further, in the illustrated embodiment, since the solvent is cleaned and refreshed by the combination of the oxidizing, decomposing and aggregating action of the ozone gas for oxidizing, decomposing and aggregating the polluted matter in the solvent and the removing and absorbing action of the filters in the cartridge filter tanks 6 and the active carbon or the like in the carbon tank 7 for removing and absorbing the polluted matter, so long as the cleaning machine 1 is driven at a solvent circulating rate suitable for the dry cleaning apparatus using the petroleum group solvent, the solvent can be maintained in the fresh condition, and the time of fresh condition recovery can be minimized even if these are alternation of solvent pollution.

Further, a temperature sensor 13 for detecting a temperature of the solvent and a conductivity sensor 12 for measuring conductivity of the solvent are arranged in the solvent circulating path R1 near and at an upstream side of a junction between the path R1 and the branched circulating path R2. The temperature sensor 13 and the conductivity sensor 12 are monitored by a control means 17. If the temperature of the solvent is risen above a predetermined value lower than the ignition (firing) point of the solvent, the control means 17 emits an alarm and deenergizes the ozone generating device 10. Further, if the conductivity of the solvent is lowered under a predetermined value, the control means 17 also emits an alarm and deenergizes the ozone generating device 10.

Since the ignition point of the petroleum group solvent used with the dry cleaning apparatus is 38° C. or more, so long as the dry cleaning apparatus is operated by using the solvent having the temperature under the predetermined value (for example, 30° C.) lower than the ignition point, ignition can be prevented. Accordingly, when the control means 17 emits the alarm and deenergizes the ozone generating device 10 as soon as the temperature of the solvent reaches 30° C., the countermeasure to the dry cleaning apparatus is enhanced and the ignition can be prevented.

Further, the conventional tests prove the fact that dangerous electrical charging which would lead to the ignition and/or explosion of the petroleum group solvent does not occur when the conductivity of the solvent is higher than 0.0001 μs/cm. Accordingly, when the control means 17 emits the alarm and deenergizes the ozone generating device 10 as soon as the conductivity of the solvent is lower under a predetermined value greater than 0.0001 μs/cm, the countermeasure to the dry cleaning apparatus is enhanced and the ignition and/or explosion which is apt to be generated during the washing operation due to static electricity can be prevented. Incidentally, in the above embodiment, while the temperature sensor 13 and the conductivity sensor 12 were arranged in the solvent circulating path R1 between the cleaning bath 8 and the carbon tank 7, such sensors may be arranged in the solvent circulating path at any position where the temperature and conductivity of the solvent can be detected and measured effectively.

As mentioned above, when outputs of the temperature sensor 13 and the conductivity sensor 12 are monitored by the control means 17 so that, If the temperature of the solvent is risen above the predetermined value and the conductivity of the solvent is lower under the predetermined value, the alarm is emitted and the ozone generating device 10 is stopped, the firing accident and/or explosion accident can be prevented. In order to further ensure the prevention of the firing accident and/or explosion accident, in the illustrated embodiment, as shown in FIG. 1, an incombustible gas source is provided (for example, $N_2$ gas generating device, $N_2$ gas bomb, or $CO_2$ gas bomb) 15 for supplying incombustible gas such as $N_2$ gas, or $CO_2$ gas effective to raise the firing point and to suppress the explosion, and the incombustible gas is introduced from the incombustible gas source 15 into a gaseous space within the solvent storage tank 2 through a valve 16. In this way, it is possible to prevent the environment, including a large amount of air, aiding the explosion by contacting with the petroleum group solvent. Further, by introducing the incombustible gas from the incombustible gas source 15 into the gaseous space within the solvent storage tank 2, the incombustible gas can be prevented from flowing into the solvent circulating path.

Incidentally, an $O_2$ sensor 14 may be provided for detecting oxygen in the gaseous space within the solvent storage tank 2. In this case, an output from the $O_2$ sensor 14 is monitored by the control means so that, if a predetermined amount of oxygen is detected, the valve 16 is opened to introduce the incombustible gas from the incombustible gas source 15 into the gaseous space within the solvent storage tank 2.

The incombustible gas source 15 may be an incombustible gas generating device or an incombustible gas bomb. For example, when an $N_2$ gas generating device is used, since $N_2$ gas can be generated by separating $N_2$ from air, the $N_2$ gas can easily be obtained without increasing the user's job and the monitoring items.

Figure 4:
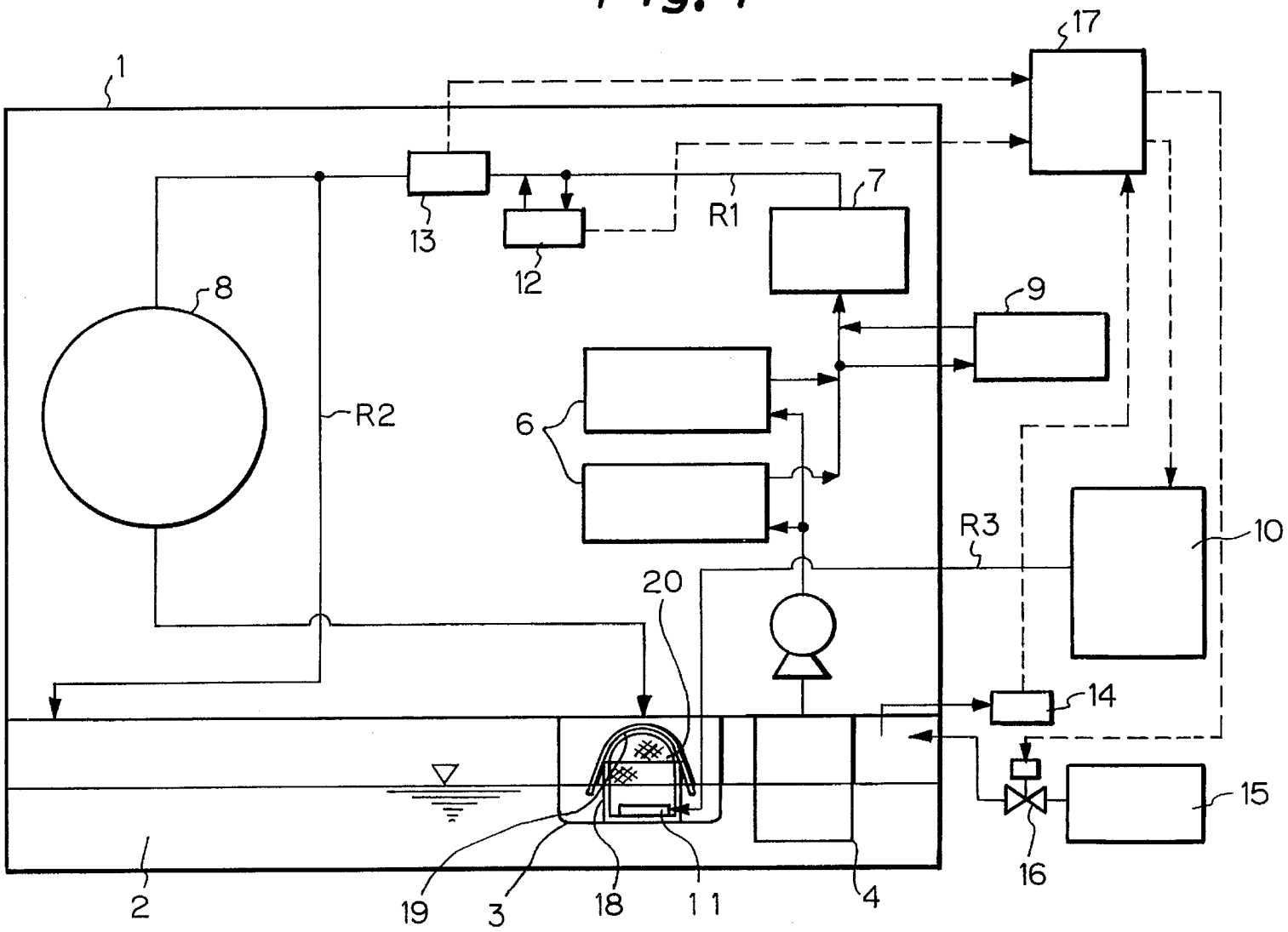
FIG. 4 is a block diagram showing a dry cleaning apparatus according to another embodiment of the present invention.

FIG. 4 is a block diagram showing a dry cleaning apparatus using petroleum group solvent according to another embodiment of the present invention. Although the construction of the dry cleaning apparatus using the petroleum group solvent according to this embodiment is substantially the same as that of the dry cleaning apparatus according to the above-mentioned first embodiment (FIG. 1), since a liquid level in the button trap 3 is low, a dome-shaped lid 19 formed from a metal net member is attached to a cylindrical case 18 formed from a metal net member, and the lid 19 is covered by a cloth web 20. Further, the cloth web 20 is secured to the lid 19 by a metal wire, and a peripheral edge portion of the cloth web is immersed into the solvent. An assembly comprised of the case 18, lid 19 and cloth web 20 is rested on the bottom surface of the button trap 3 in such a manner that the case 18 is contacted with the bottom surface of the button trap 3. Further, the diffuser 11 is arranged within the case 18 to be contacted with the bottom of the case.

Since the peripheral edge portion of the cloth web 20 is immersed into the solvent, and the solvent discharged from the cleaning bath 8 and the replenished solvent are applied onto the cloth web 20, the cloth web 20 is always maintained In a wetted condition. Further, since the solvent discharged from the cleaning bath 8 includes the polluted matter, the polluted matter Is always supplied to the cloth web 20.

If the liquid level in the button trap is low to shorten the contact distance between the ozone and the solvent, in some cases, the ozone will not be consumed completely to escape from the solvent. Further, if the amount of the polluted matter In the solvent is very little, in some cases, the ozone will not be consumed completely to escape from the solvent. When dry cleaning soap agent (surface-active agent) is not added to the solvent or when only a small amount of soap agent is added to the solvent, since it is difficult to dissolve the polluted matter out of the laundry, such difficulty increases.

In such a case, when the case 18 formed from the metal net member is contacted with the bottom surface of the button trap 3 and the ozone gas from the diffuser 11 is diffused into the solvent as fine bubbles, foam swells or grows in the case to form a foam layer. While the ozone gas is being passed through the foam layer, the ozone gas is decomposed, thereby preventing the ozone from escaping into the atmosphere. Further, when the dome-shaped lid 19 formed from the metal net member is attached to the upper end of the case 18 and the lid is covered by the cloth web 20, even if the growth of foam in the case 18 is insufficient to leak a small amount of ozone through the foam layer, while the ozone is being passed through the cloth web 20, the ozone is consumed and decomposed by the polluted matter constantly being supplied to the cloth web 20 to maintain the cloth web in the wetted condition, thereby preventing the ozone from escaping into atmosphere.

According to a test performed under the condition whereby cotton rubbish accumulated in the button trap 3 is uniformly rested on the lid 19 formed from the metal net member In place of the cloth web 20 and the solvent discharged from the cleaning bath 8 is supplied onto the cotton rubbish layer, it was found that the ozone gas could be prevented from escaping into the atmosphere, similar to the cloth web 20. Accordingly, by covering the lid 19 by fibrous material having density equal to or greater than the density of the cloth web 20 and by always maintaining the fibrous material in a wetted condition with the solvent including the polluted matter, it is possible to prevent the ozone gas from escaping into the atmosphere.

Although there is no limitation regarding the mesh size of the metal net member forming the case 18 and the lid 19, in order to contact the ozone gas supplied from the diffuser 11 with the solvent sufficiently, the mesh size of the metal net member may be selected so that the solvent can pass through the metal net member without obstruction, and the ozone gas emitted through the solvent is not confined in the case 18 and can pass through the lid 19 while contacting with the cloth web 20 or fibrous material rested on the lid. Incidentally, in the above embodiment, while an example that the case 18 and the lid 19 are formed from the metal net members was explained, the present invention is not limited to such an example. For example, the case and the lid may be formed from net members made of resin such as Teflon so long as the net members have solvent resistance. Further, the case and the lid may be formed from any porous members having solvent resistance other than the net members so long as the solvent can pass through such members without obstruction, and the ozone gas emitted through the solvent is not confined in the case 18 and can pass through the lid 19 while contacting with the cloth web 20 or fibrous material rested on the lid in order to contact the ozone gas supplied from the diffuser 11 with the solvent sufficiently.

Figure 5A:
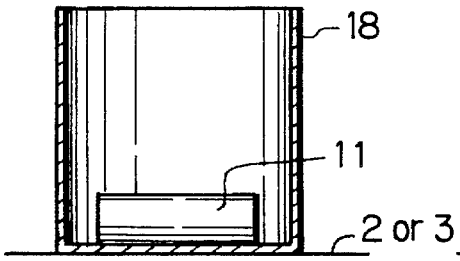
FIGS. 5A and 5B are sectional views showing cases within which a diffuser is installed.
Figure 5B:
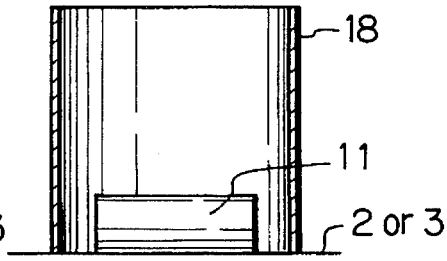

FIGS. 5A to 7C show various cases 18. Each case 18 is formed from a metal net member or a porous member. FIG. 5A shows a cylindrical case 18 having a bottom and an open top. In this case, the diffuser 11 is arranged within the case to be contacted with the bottom of the case. And, the case 18 is arranged to be contacted with a bottom of the solvent storage tank 2 or the button trap 3. FIG. 5B shows a cylindrical case 18 having an open top and an open bottom, and the case is so arranged that the open bottom of the case is contacted with the bottom of the solvent storage tank 2 or the button trap 3. In this case, the diffuser 11 is arranged within the case to be contacted with a portion of the bottom of the solvent storage tank 2 or the button trap 3 encircled by the open bottom of the case 18.

Figure 6A:
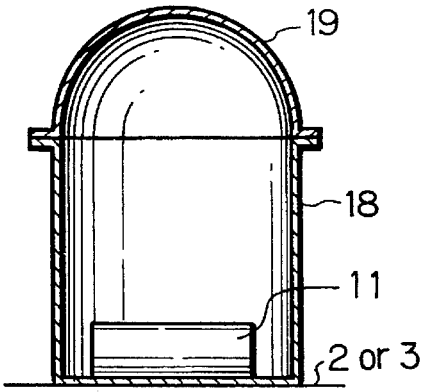
FIGS. 6A and 6B are sectional views showing cases within which a diffuser is installed in an alternate form.
Figure 6B:
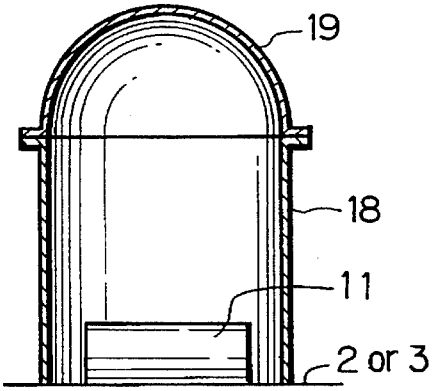

FIG. 6A shows a cylindrical case 18 having a bottom and an open top, and a dome-shaped lid 19 formed from a metal net member or a porous member is attached to the open top. In this case, the diffuser 11 is arranged within the case to be contacted with the bottom of the case, and the case 18 is arranged to be contacted with the bottom of the solvent storage tank 2 or the button trap 3. FIG. 6B shows a cylindrical case 18 having an open top and an open bottom, and a dome-shaped lid 19 formed from a metal net member or a porous member is attached onto the open top. In this case, the case is so arranged that the open bottom of the case is contacted with the bottom of the solvent storage tank 2 or the button trap 3, and the diffuser 11 is arranged within the case to be contacted with a portion of the bottom of the solvent storage tank 2 or the button trap 3 encircled by the open bottom of the case 18.

Figure 7A:
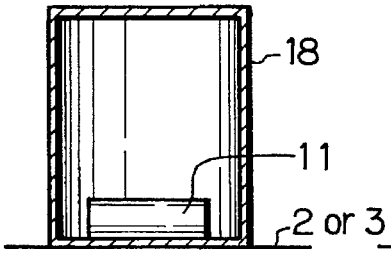
FIGS. 7A to 7C are sectional views showing cases within which a diffuser is installed in a further alternate form.
Figure 7B:
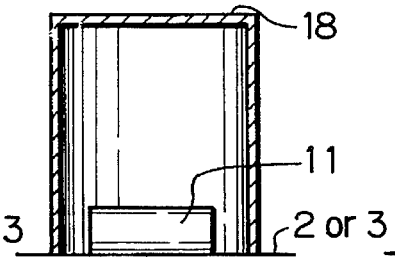
Figure 7C:
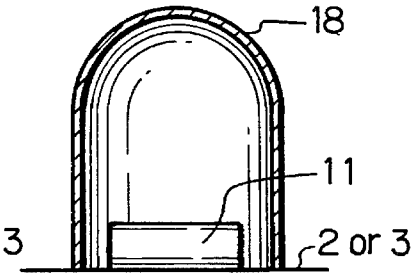

FIG. 7A shows a cylindrical case 18 having a bottom and a closed top. In this case, the diffuser 11 is arranged within the case to be contacted with the bottom of the case, and the case 18 is arranged to be contacted with the bottom of the solvent storage tank 2 or the button trap 3. FIG. 7B shows a cylindrical case 18 having a closed top and an open bottom. In this case, the case is so arranged that the open bottom of the case is contacted with the bottom of the solvent storage tank 2 or the button trap 3, and the diffuser 11 is arranged within the case to be contacted with a portion of the bottom of the solvent storage tank 2 or the button trap 3 encircled by the open bottom of the case 18. Further, FIG. 7C shows a cylindrical case 18 having a dome-shaped closed top and an open bottom. In this case, the case is so arranged that the open bottom of the case is contacted with the bottom of the solvent storage tank 2 or the button trap 3, and the diffuser 11 is arranged within the case to be contacted with a portion of the bottom of the solvent storage tank 2 or the button trap 3 encircled by the open bottom of the case 18.

As shown in FIGS. 7A to 7C, when the case 18 having the closed top is used, the closed top is regarded as a lid, and the closed top is covered by the cloth web 20 or the fibrous material which is always maintained in a wetted condition by the solvent including the polluted matter. Also in this case, It should be noted that it is possible to prevent the ozone gas above the diffuser 11 from escaping into the atmosphere.

According to a cleaning ability test performed by using the dry cleaning apparatus as shown in the above-mentioned embodiment, it was found that the cleaning rate for the soluble dirt is remarkably improved and the re-polluting rate is decreased.

As mentioned above, the active carbon or the like is contained in the carbon tank 7. Thus, the ozone produced by electrical discharge In air (i.e., ozonized air) is used as the ozone gas to be applied into the solvent, there is a danger of explosion if the ozonized air is passed through the active carbon in the carbon tank 7, because nitrogen oxides (NOx) included in the ozonized air reacts against the active carbon. To eliminate such a danger, in the illustrated embodiment, ozone gas generated by electrical discharge in a gas in which oxygen density is 70 vol % or more is used as the ozone gas to be applied into the solvent.

Figure 8:
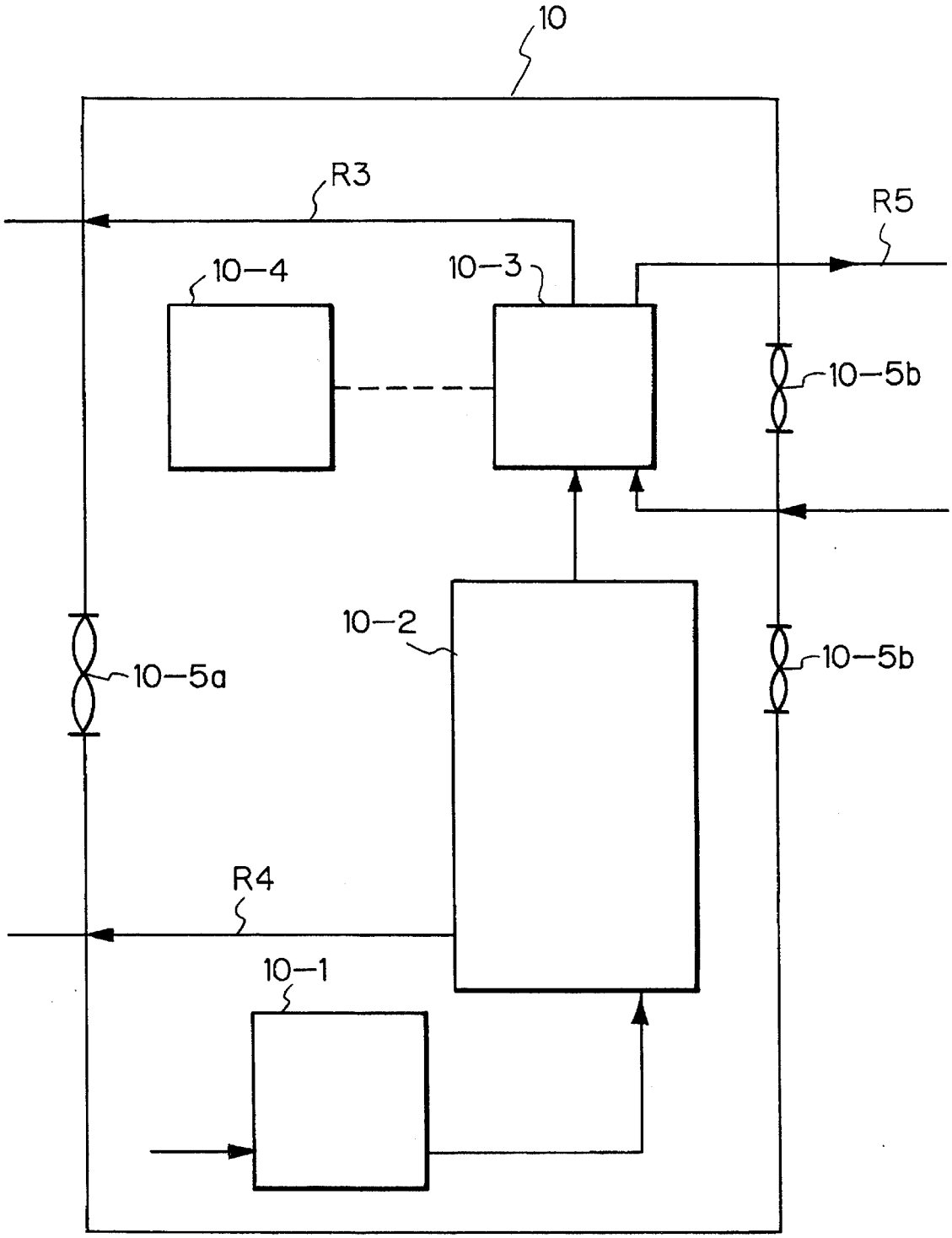
FIG. 8 is a block diagram showing an ozone generating means.

FIG. 8 is a block diagram showing an example of an ozone generating device 10. This ozone generating device 10 comprises a compressor 10-1, an oxygen enricher 10-2, a discharging cell 10-3 and a power source 10-4. Air is compressed by the compressor 10-1, and the compressed air is sent to the oxygen enricher 10-2 where nitrogen ($N_2$) and oxygen ($O_2$) are separated from the air, and the oxygen ($O_2$) alone is selected. The selected oxygen ($O_2$) is sent to the discharging cell 10-3 where electrical discharge is carried out in oxygen gas discharged by high voltage applied to the discharging cell 10-3 from the power source 10-4, thereby ozone ($O_3$) is produced. The produced ozone is sent to the diffuser 11 shown in FIG. 1 through the conduit R3.

In the illustrated embodiment, while an example whereby the diffuser 11 is disposed within the button trap 3 of the dry cleaning machine 1 including the cartridge filter tanks 6 and the carbon tank 7 (i.e., filters and active carbon) and the ozone gas is supplied from the ozone generating device 10 to the diffuser 11 was explained, the dry cleaning machine 1 is not limited to this example, but the solvent storage tank, filter and active carbon may be arranged outside the dry cleaning machine. For example, the solvent from the cleaning bath 8 may be discharged out of the dry cleaning machine 1, finely bubbled ozone gas may be applied into the solvent to oxidize, decompose and aggregate the polluted matter included in the solvent under the action of the ozone gas, the oxidized, decomposed and aggregated polluted matter may be caught and absorbed by a filter and absorbent arranged outside the dry cleaning machine 1 to clean the solvent, and the cleaned solvent may be returned to a solvent storage tank arranged outside the dry cleaning machine 1.

As mentioned above, the ozone gas is applied into the solvent including the polluted matter to oxidize, decompose and aggregate the polluted matter under the action of the ozone. When the oxidized, decomposed and aggregated polluted matter is continuously caught and absorbed by the filter and absorbent, the catching ability of the filter and absorbing ability of the absorbent are gradually worsened. Thus, in order to keep the effect for cleaning the solvent, the filter and the absorbent must be exchanged frequently. That is to say, If the caught and absorbed polluted matter is stored in the dry cleaning apparatus for a long time, they are condensed to increase density thereof so that they may be reformed or be dissolved into the solvent again, thereby trouble may be caused.

To avoid this, when a distilling device is added to the dry cleaning apparatus according to the illustrated embodiment, since loads on the filter and absorbent are decreased, the exchanging frequency of the filter and absorbent can be decreased. Further, since the polluted matter is removed from the dry cleaning apparatus within a relatively short hour, the reformation of the polluted matter due to accumulation thereof and the re-melting of the polluted matter into the solvent can be eliminated or minimized, thereby achieving the effect of addition of the distilling device as well as the effect of the pouring of the ozone efficiently. Of course, the frequency of use of the distilling device can be decreased remarkably in comparison with the frequency of use thereof before the ozone is applied into the solvent.

Further, since the polluted matter oxidized and decomposed under the action of the ozone is changed to various substances, use of optimum absorbent is effective to increase the absorbing ability of the absorbent. Thus, as well as the use of active carbon, active alumina or active clay alone, combination of such active carbon or the like and zeolite, silica gel or ion-exchange resin can be used depending upon the material to be absorbed in order to further improve the refreshing ability of the solvent.

Advantages

As mentioned above, according to the method of the present invention, the following excellent advantages can be obtained:

(1) Since the polluted matter (included in the solvent) oxidized, decomposed and aggregated under the action of the ozone gas applied into the solvent can easily be removed by the filter and/or absorbent, it is possible to maintain the petroleum group solvent in the fresh condition. Further, the bad smell of the solvent itself and the bad smell of the polluted matter accumulated in the solvent can be decomposed and deodorized.

(2) Further, since the ozone gas is applied into the petroleum group solvent through the fine pores of the diffuser, the contact area between the ozone gas and the solvent can be increased, and, thus, reaction between the ozone and the polluted matter can be enhanced to effectively oxidize, decompose and aggregate the polluted matter, thereby it is possible to maintain the petroleum group solvent in a fresh condition and preventing the bad smell from leaking into the surroundings to provide a good cleaning environment. Further, since the deodorized solvent is always supplied to the cleaning bath, it is possible to prevent the bad smell from transferring onto the laundry.

(3) Since the petroleum group solvent has high ozone melting ability and the ozone is applied into the solvent as fine bubbles, a special ozone processing device is not required. Accordingly, only by supplying the ozone gas from the ozone generating device to the diffuser through a pipe and by pouring the ozone gas into the solvent as fine bubbles, the solvent can easily be deodorized without modifying the conventional dry cleaning apparatus using a lot of the petroleum group solvent.

(4) Since the ozone gas is applied into the solvent flowing in the solvent circulating path at the position downstream of the cleaning bath and upstream of the filter, the ozone can act on the mostly polluted solvent. Further, since the polluted matter oxidized, decomposed and aggregated under the action of the ozone can be removed by the filter and/or absorbent promptly, the solvent can be cleaned efficiently.

(5) Since the ozone gas produced by electrical discharge in a gas in which oxygen density is 70 vol % or more is used as the ozone gas to be applied into the solvent, even when the active carbon is used to remove or absorb the oxidized, decomposed and aggregated polluted matter, explosion does not occur.

Further, according to the apparatus of the present invention, the following excellent advantages can be obtained:

(6) Since the diffuser is arranged to be contacted with the bottom surface of the solvent storage tank or the button trap at the downstream side of the cleaning bath so that the ozone gas from the ozone generating device is applied into the petroleum group solvent which includes the polluted matter through the diffuser, the polluted matter and the smell components are oxidized, decomposed and aggregated and then are removed by the filter and the absorbent, thereby it is possible to maintain the petroleum group solvent in the fresh condition, providing highly stable cleaning ability and good cleaning finish for a long time and maintain a good cleaning environment without any bad smell.

(7) Further, since the temperature sensor for detecting the temperature of the solvent and the conductivity sensor for measuring the conductivity of the solvent are disposed at the predetermined positions in the solvent circulating path, so that, if the temperature of the solvent is risen above the predetermined value lower than the firing point of the solvent or if the conductivity of the solvent is lowered under the predetermined value higher than 0.0001 μs/cm, the alarm is emitted and/or the ozone generating device is stopped, accidental fire and explosion can be prevented.

(8) Moreover, since the nonflammable gas is introduced into the gaseous space within the solvent storage tank, the danger of ignition is further reduced.

(9) Lastly, by providing the simple construction wherein the lid made of net material or porous material is attached to the top of the case made of net material or porous material and containing the diffuser therein, and the lid is covered by the cloth web or fibrous material maintained in the wetted condition, it is possible to prevent the ozone from escaping into atmosphere.

What is claimed is:

1. A dry cleaning apparatus wherein a cleaning bath, a storage tank for storing cleaning petroleum group solvent, a circulating pump, a filter and absorbent are successively connected through a solvent circulating path, and the petroleum group solvent in said storage tank is pumped by said circulating pump, is supplied to said cleaning bath through said filter and said absorbent, and then is returned from said cleaning bath to said storage tank, and characterized in that:

said apparatus further comprises an ozone gas generating device, and a diffuser for applying ozone gas into the solvent as fine bubbles, said ozone gas generating device serving to produce the ozone gas by electrical discharge in a gas in which oxygen density is 70 vol % or more, said absorbent including at least one of active carbon, active alumina and active clay so that the ozone gas in the solvent passing through the absorbent is decomposed and eliminated, and said diffuser being arranged within said storage tank.

2. A dry cleaning apparatus according to claim 1, wherein a button trap is disposed within said storage tank, and wherein the solvent is returned from said cleaning bath to said storage tank through said button trap, and said diffuser is arranged so that a portion thereof is contacted with a bottom surface of said button trap.

3. A dry cleaning apparatus according to claim 2, wherein an upper space within said button trap above said diffuser is covered by a cloth web supported by a case and a lid made of net material or porous material, and said cloth web is always maintained in a wetted condition by the solvent.

4. A dry cleaning apparatus according to claim 1, wherein said diffuser is arranged so that a portion thereof is contacted with a bottom surface of said storage tank and so that an upper space above said diffuser is covered by a cloth web supported by a case and a lid made of net material or porous material.

5. A dry cleaning apparatus according to claim 4, wherein, if density of oxygen in a gaseous space within said storage tank is increased above predetermined density, a nonflammable gas is introduced into said gaseous space within said storage tank from a nonflammable gas source.

6. A dry cleaning apparatus according to claim 1, wherein said absorbent includes at least one of zeolite, silica gel and ion-exchange resin.

7. A dry cleaning apparatus according to claim 1 wherein a nonflammable gas is introduced into a gaseous space within said storage tank, thereby preventing ignition and explosion of the solvent.

* * * * *